United States Patent [19]

Miura et al.

[11] Patent Number: 4,589,387

[45] Date of Patent: May 20, 1986

[54] VALVE OPERATING DEVICE WITH STOPPING FUNCTION FOR INTERNAL COMBUSTION ENGINE

[75] Inventors: Seishi Miura, Saitama; Takaaki Tsukui, Tokyo, both of Japan

[73] Assignee: Honda Giken Kogyo Kabushiki Kaisha, Tokyo, Japan

[21] Appl. No.: 751,170

[22] Filed: Jul. 2, 1985

[30] Foreign Application Priority Data

Jul. 2, 1984 [JP] Japan ..... 59-136949
Aug. 13, 1984 [JP] Japan ..... 59-168948

[51] Int. Cl.[4] ..... F01L 1/34

[52] U.S. Cl. ..... 123/198 F; 123/90.16; 123/90.17

[58] Field of Search ..... 123/198 F, 90.15, 90.16, 123/90.17, 90.27, 90.46

[56] References Cited

U.S. PATENT DOCUMENTS

| | | | |
|---|---|---|---|
| 4,353,334 | 10/1982 | Neitz | 123/90.16 |
| 4,389,985 | 6/1983 | Huber et al. | 123/198 F |
| 4,478,187 | 10/1984 | Yamada | 123/198 F |
| 4,534,323 | 8/1985 | Kato et al. | 123/198 F |
| 4,537,164 | 8/1985 | Ajiki et al. | 123/90.16 |
| 4,537,165 | 8/1985 | Honda et al. | 123/90.16 |
| 4,545,342 | 10/1985 | Nakano et al. | 123/198 F |

*Primary Examiner*—Ira S. Lazarus
*Attorney, Agent, or Firm*—Sughrue, Mion, Zinn, Macpeak, and Seas

[57] ABSTRACT

A valve operating device for internal combustion engine which includes a cam shaft rotated by a crankshaft and a rocker arm which follows the cam of the cam shaft to open and close an intake or exhaust valve of the engine. Oil-pressure-operated control is provided for suspending the operation of the intake or exhaust valve according to the operating conditions of the engine. For this purpose, a cam shaft passage is formed in an oil pressure supplying passage which extends from an oil pressure source through an oil passage in the rocker shaft to the control mechanism in such a manner that the cam shaft passage extends through one end portion of the cam shaft. A changeover valve for opening and closing the cam shaft passage is provided at the one end portion of the cam shaft. A centrifugal governor provided at the one end portion of the cam shaft rotates with the cam shaft and turns the changeover valve when the speed of the cam shaft is in a predetermined range, thereby to communicate the oil pressure source with the control mechanism.

3 Claims, 16 Drawing Figures

VALVE OPERATING DEVICE WITH STOPPING FUNCTION FOR INTERNAL COMBUSTION ENGINE

BACKGROUND OF THE INVENTION

The present invention relates to a valve operating device having a stopping function for use in an internal combustion engine which controls the operation of an intake or exhaust valve according to the speed of the engine. More particularly, the invention relates to an oil pressure changeover valve which, in such a valve operating device, operates to select between a condition where oil pressure is applied from an oil pressure supplying source to an oil-pressure-operated part and a condition where the oil-pressure-operated part is opened to the atmosphere.

A conventional valve operating device of this type includes a cam shaft supported by a cylinder head and rotated in association with the crankshaft and a rocker arm which is rockably mounted on a rocker shaft supported by the cylinder head and which opens and closes an intake or exhaust valve following the rotation of a cam mounted on the cam shaft. The rocker arm has an oil-pressure-operated control mechanism which stops the operation of the intake or exhaust valve for specified operating conditions of the engine.

Such a control mechanism is shown in FIG. 1. A rocker arm assembly 3 is rockably mounted on a rocker shaft 2, which is in the form of a pipe having an oil passage 1. The rocker arm assembly 3 is composed of a first rocker arm 4 and a second rocker arm 5. The first and second rocker arms 4 and 5 are detachably engaged through a plunger pin 6. If the corresponding valve is to be activated, oil pressure is applied from an oil pressure source through the oil passage 1 to an oil pressure chamber 7 so as to force the plunger pin 6 in the second rocker arm 5 towards the first rocker arm 4 to thereby engage the first and second rocker arms 4 and 5 with each other. As a result, the second rocker arm 5 moves together with the first rocker arm 4, the latter following a cam (not shown) and thus being pivoted about the rocker shaft 2, causing the end portion of the second rocker arm 5 to operate the intake or exhaust valve 8. To deactivate the operation of the valve, the application of the oil pressure to the oil pressure chamber 7 is interrupted by a selector valve (not shown) so that the plunger pin 6 is restored, that is, the first and second rocker arms 4 and 5 are disengaged from each other. As a result, the rocking motion of the first rocker arm 4 is not transferred to the second arm 5.

Conventionally, switching between valve activated and deactivated states is conducted in accordance with a predetermined operating condition of the engine such as the engine speed. Typically, the engine speed is detected electrically and the operation of a solenoid valve is controlled thereby to switch the application of oil pressure to the oil pressure chamber 7.

The solenoid valve is typically constructed as shown in FIG. 2. A directly operated spool 102 is slidably mounted in a casing 101. The spool 102 is driven by a solenoid 103 to select one of a position (shown in FIG. 2) where a port 104 (connected to an actuator, namely, an oil-pressure-operated part) communicates with a return port 105 (connected to the oil tank) and a position where a port 106 (connected to an oil pump, namely, an oil pressure supplying source) communicates with the port 104.

Such solenoid valves have been extensively employed. For instance, such a solenoid valve is often used in the oil pressure circuit of a valve operating device of the type shown in FIG. 1.

However, such a valve operating system is disadvantageous in that it is relatively high in manufacturing cost because it requires expensive components such as the detecting device and solenoid valve, and it has a large number of components.

Instead of electrical control, mechanical control may be employed. In this case, a mechanical hydraulic changeover valve must be employed. However, such valves are inherently complex and costly and have not been used extensively.

SUMMARY OF THE INVENTION

In view of the foregoing, an object of the invention is to provide a mechanical changeover control device in which the above-described difficulties related to manufacturing cost, number of components, etc., have been eliminated.

In order to overcome the above-described difficulties, according to the invention, a valve operating device is provided in which a cam shaft passage passing through one end portion of a cam shaft is provided in an oil supplying passage which extends from an oil pressure source through an oil passage in a rocker shaft to a control mechanism in an rocker arm, a changeover valve is provided for opening and closing the cam shaft passage, the changeover valve being mounted at the one end portion of the cam shaft, and a centrifugal governor is provided, also at the one end portion of the cam shaft. The governor rotates with the cam shaft. When the governor rotates in a predetermined range of speed, the changeover valve is turned to communicate the oil pressure source with the control mechanism.

The nature, utility and principle of the invention will become more apparent from the following detailed description when read in conjunction with the accompanying drawings.

DESCRIPTION OF THE PREFERRED EMBODIMENTS

Figure 1:
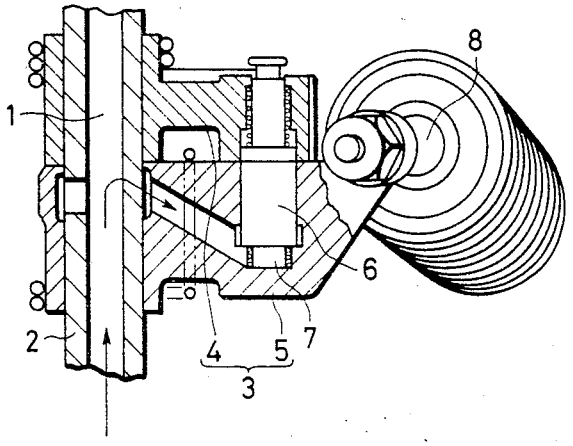
FIG. 1 PRIOR ART
FIG. 1 is a sectional view showing essential components of a conventional rocker arm assembly 5.
Figure 2:
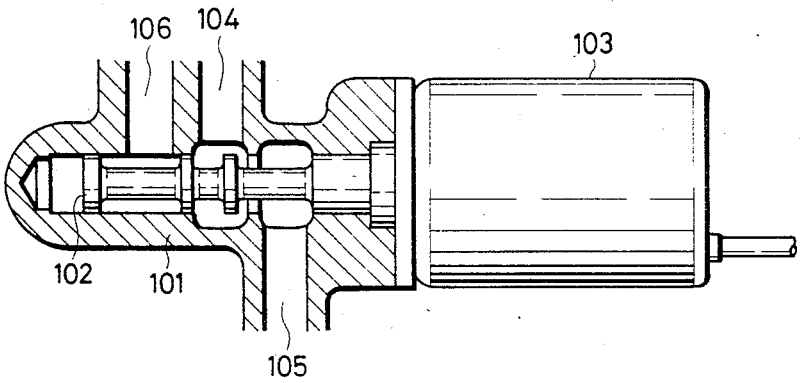
FIG. 2 PRIOR ART
FIG. 2 is a sectional view showing a conventional solenoid valve.
Figure 3:
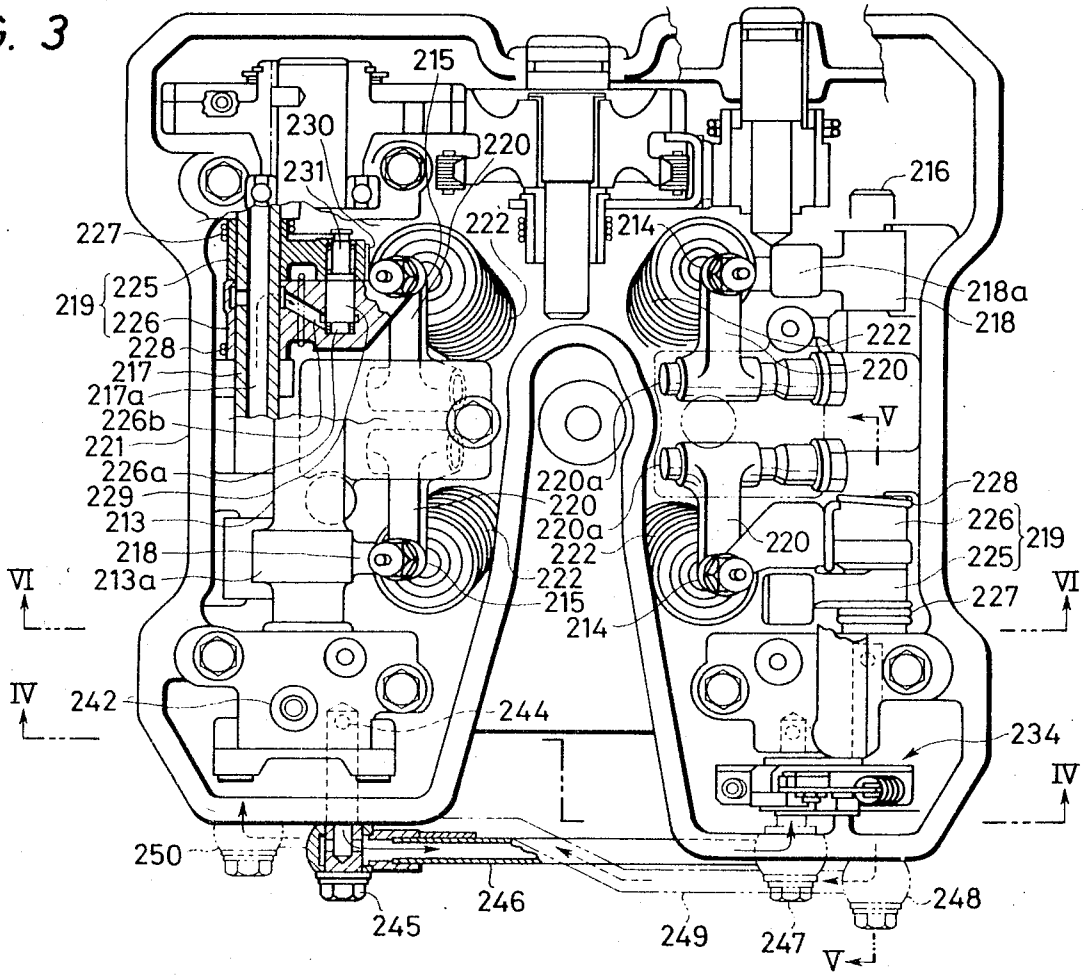
FIG. 3 is a plan view showing the cylinder head of a single-cylinder four-valve engine.
Figure 4:
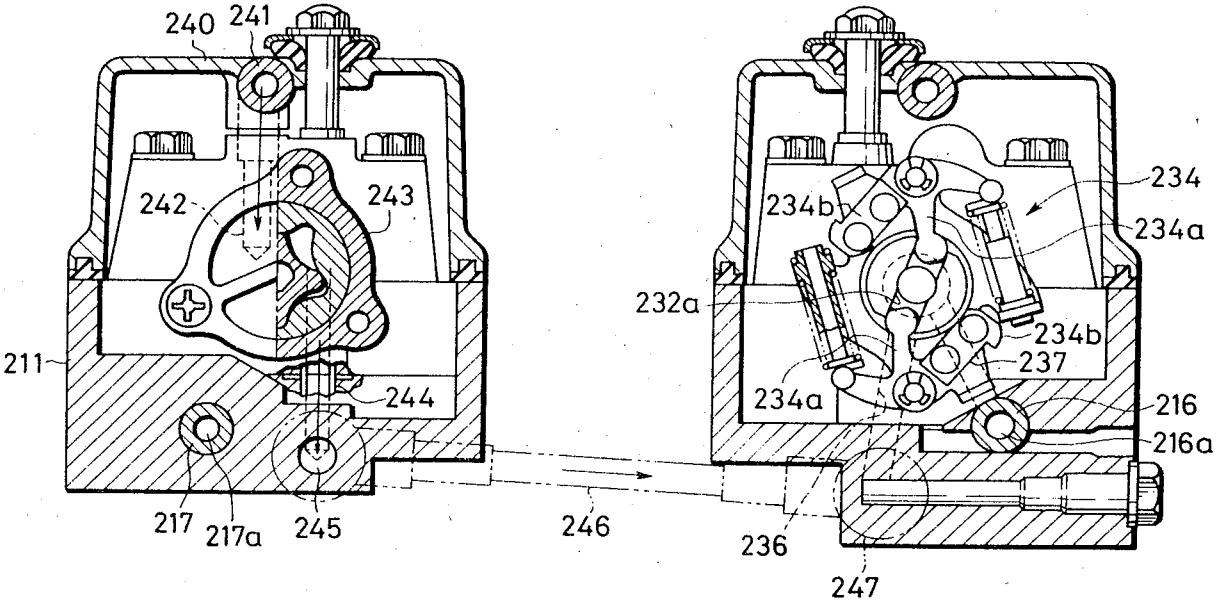
FIG. 4 is a sectional view taken along a line IV—IV in FIG. 3.

FIG. 3 is a plan view of the cylinder head of an engine, showing the engine from which the cylinder head cover has been removed. FIGS. 4, 5 and 6 are sectional views taken along lines IV—IV, V—V and VI—VI, respectively, in FIG. 3. In these figures, reference numeral 211 designates a cylinder head; 212, a cam shaft on the intake valve side; and 213, a cam shaft on the exhaust valve side. The cam shafts 212 and 213, respectively, and are supported by the cylinder head 21. A constant operation type rocker arm 218 and a changeover type rocker arm 219 are mounted on the rocker shafts 216 and 217, respectively.

As shown in FIG. 6, the constant operation type rocker arm 218 (only the rocker arm on the exhaust valve side being shown in FIG. 6) has a projecting part **218*a* which is in contact with a cam 213*a* (or 212*a*) so that the rocker arm is pivoted about the rocker shaft 217 (or 216) following the valve 215 (or intake valve 214) via a tappet arm 220** at all times.

In FIG. 6, reference numeral 221 designates a valve guide; 222 and 223, valve springs; and 224, a valve spring retainer. As shown in FIG. 3, four tappet arms 220 are provided for the respective intake valves 214 and the exhaust valves 215. Each tappet arm 220 is rotatably mounted on a respective tappet shaft **220*a* supported by the cylinder head 211, with its end portion located between the rocker arms 218 and 219. The tappet arms 220 are provided to minimize the sliding of the valve tops in the intake and exhaust valves 214 and 215**.

The changeover type rocker arm 219 includes a first rocker arm 225 and a second rocker arm 226. As shown in FIG. 6, the first rocker arm 225 has a projecting part **225*a* which contacts a cam 212*a* (or 213*a*). The first rocker arm 225 is urged towards the cam 212*a* (or 213*a*) following the latter. The end of the second rocker arm 226 abuts against the head of the intake or exhaust valve 21*e* or 215 through the via the tappet arm 220 and is urged towards the valve head by a torsion spring 228. A plunger pin 229 is slidably provided in the second rocker arm and is engageable in the cylindrical hole of the first rocker arm 225. A pin 231 for pushing back the plunger pin 229 with the aid of a return spring 230 is provided in the first rocker arm 225. An oil pressure chamber 226*a* is formed at the rear of the plunger pin 229 in the second rocker arm 226. The oil pressure chamber 226*a* is communicated with an oil passage 217*a* in the rocker shaft 217 (or 216**).

Figure 5A:
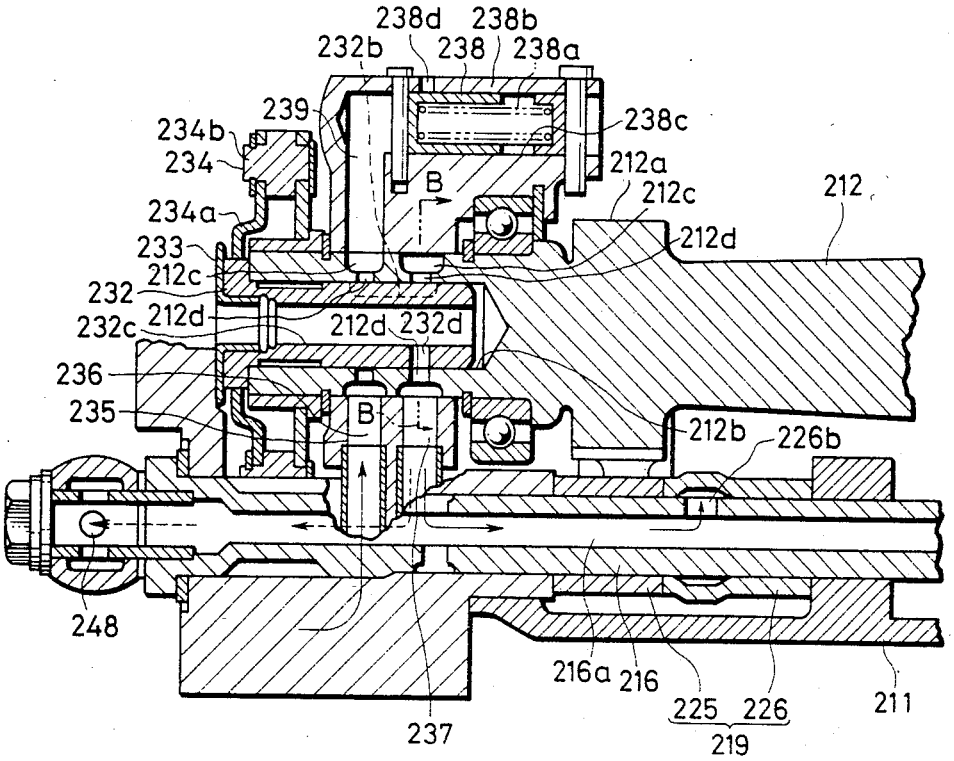
FIG. 5A is a sectional view taken along a line V—V in FIG. 3, and FIGS. 5B and 5C are sectional views taken along line B—B in FIG. 5A, showing different states of the changeover valve.
Figure 5B:
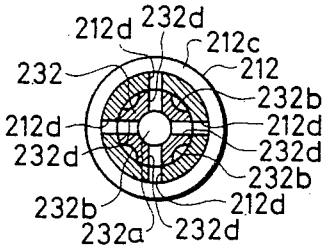
Figure 5C:
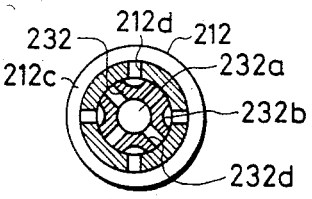
Figure 6:
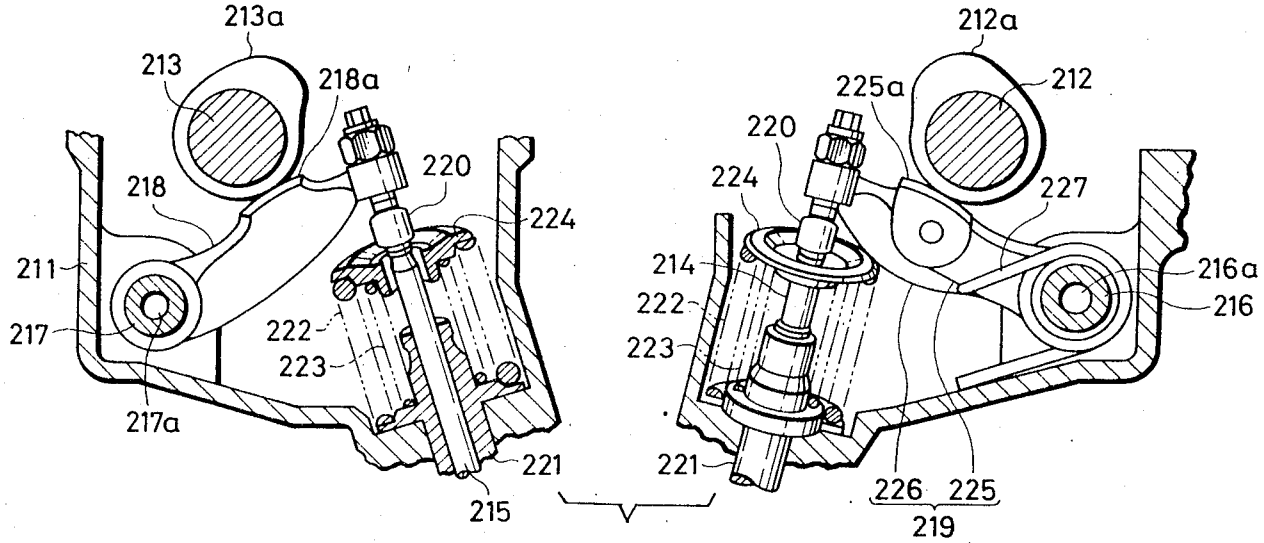
FIG. 6 is a sectional view taken along a line VI—VI in FIG. 3.

In accordance with the invention, as shown best in FIGS. 5A to 5C, a cylindrical hole **212*b* is formed in one end portion of the cam shaft 212 (the cam shaft shown in FIG. 5 being for the intake valve). The rotary valve (changeover valve) 232 is inserted into the cylindrical hole 212*b*. The rotary valve is held in position abutted against the wall of the cylinder head 211 through a washer 233. A centrifugal governor 234 is mounted on the one end portion of the cam shaft 212 by spline coupling. The centrifugal governor 234 has arms 234*a* which are engaged with cuts 232*a* formed in the end face of the rotary valve 232. As governor weights 234*b* coupled to the arms 234*a* are moved by centrifugal force, the rotary valve 232** is rotated.

A first communicating passage 236 (cam shaft passage) communicated with a main oil pump (oil pressure source), a second communicating passage 237 (cam shaft passage) communicated through an oil passage **216*a* in the rocker shaft 216 with the oil pressure chamber 226*a* in the second rocker arm 226, and a third communicating passage 239 communicated with a relief valve 238 (described below) are formed in a passage member 235 into which the one end portion of the cam shaft 12** is inserted.

Two annular grooves **212*c* are formed in the outer wall of the cam shaft 212, which is in contact with the first, second and third communicating passages 236, 237 and 239, and are communicated with the rotary valve 232 through communicating holes 212*d*. Communicating grooves 232*b* are formed in the outer wall of the rotary valve 232 and extend in the axial direction. The communicating grooves 232*b* are used to communicate the two annular grooves 212*c* with each other when the rotary valve turns through a predetermined angle. Leak holes 232*d* are formed in the outer wall of the rotary valve 232. The leak holes 232*d* are used to communicate the second communicating passage 237 with a return through-hole 232*c* formed in the rotary valve 232**.

The aforementioned relief valve 238 is positioned above the rotary valve 232. A piston **238*b* is slidably received in the cylindrical hole 238*c* of the relief valve 238 and is biased by a spring 238*a*. The relief valve 238 has a relief hole 238*d*** opened to the atmosphere.

Figure 8A:
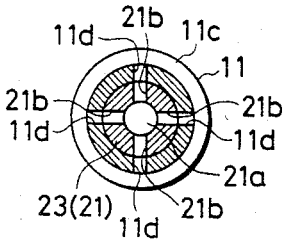
FIGS. 8A and 8B are sectional views taken along a line VIII—VIII, showing different states of the changeover valve.
Figure 8B:
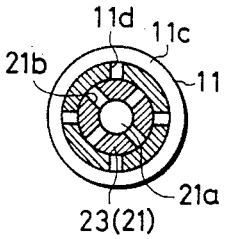

The oil passage will be described in more detail. A main oil pump is driven by the engine to supply oil. The oil thus supplied, as shown in FIG. 8, flows through a passage 241 formed in the cylinder head cover 240 and a passage 242 to a pressure increasing oil pump 243 where its pressure is boosted. The oil then flows through a passage 244, a coupling 245, a communicating pipe 246, a coupling 247 on the intake valve side, and the first communicating passage 236 to the rotary valve 232. The oil flows from the rotary valve 232 to the second communicating passage 237 where it is divided into two parts. One of the two parts is supplied from the second communicating passage 237 through an oil passage **216*a* in the rocker shaft 216 on the intake valve side of the oil pressure chamber 226*a* in the second rocker arm 226 of the changeover type rocker arm 219 on the intake valve side. The other part is supplied from the second communicating passage 237 through a coupling 248 (FIG. 3), the communicating pipe 249, a coupling 250, and an oil passage 217*a* in the rocker shaft 217 on the exhaust pipe side to an oil pressure chamber 226*a* in the second rocker arm of the changeover type rocker arm 219** on the exhaust valve side.

The aforementioned pressure boosting oil pump 243 is a trochoid pump which is provided at the one end of the cam shaft 213 on the exhaust valve side. The reason why the oil pump 243 is separately provided is that doing so results in a smaller drive loss than if the discharge pressure of the main oil pump were increased. However, it should be noted that it is not always necessary to employ th separate pressure increasing oil pump 243.

With respect to the above-described passages, the flow of oil to the rocker arm on the intake valve side is indicated by solid line arrows, and the flow of oil to the rocker arm 219 on the exhaust valve side is indicated by broken line arrows.

In the above-described embodiment, the plunger pin 229 in the second rocker arm 226, the oil pressure chamber 226*a* formed behind the plunger pin 229, the return pin 231 in the first rocker arm 225, and the return spring 230 form a control mechanism for selectively activating and deactivating the intake or exhaust valve.

When the speed of the engine is in the low-speed range, the relevant components are positioned as shown in FIGS. 3, 4, 5A to 5C, 6 and 11, and the intake or exhaust valve 214 or 215 to be controlled by the changeover type rocker arm 219 is deactivated. That is, the centrifugal governor 234 rotating with the cam shaft 212 is in the closed state. The rotary valve 232, as shown in FIGS. 5A and 5B, closes the first and second communicating passages 236 and 237, and the second communicating passage is communicated through the annular groove 212*c*, the communicating holes 212*d* and the leak holes 232*d* to the return through-hole 232*c*. Accordingly, the oil from the main oil pump (not shown) is not applied to the oil pressure chamber 226*a* in the second rocker arm 226, and because the pressure is removed from the oil pressure chamber 226*a*, no oil pressure is applied to the rear end face of the plunger pin 229. Therefore, the plunger pin 229 is pushed back by the return pin 231, as a result of which the first rocker arm 225 and the second rocker arm 226 are disengaged from each other, and the rocking motion of the first rocker arm 225 following the cam 212*a* (213*a*) is not transmitted to the second rocker arm 226. Hence, the corresponding intake valve 214 or exhaust valve 215 is maintained closed. That is, the valve is deactivated.

When the speed of the engine reaches a predetermined value, the governor weights 234*b* of the centrifugal governor 234 are shifted. As the arms 234*a* engage with the cuts 232*e* of the rotary valve 232, the latter is turned through a predetermined angle by the arms 234*a*, as a result of which the communicating groove 232*b* in the rotary valve 232 confronts the communicating holes 212*d* of the two annular grooves 212*c*. Accordingly, oil from the main oil pump is supplied through the first communicating passage 236, one of the annular grooves 212*c*, one communicating hole 212*d*, the communicating groove 232*b* of the rotary valve 232, another communicating hole 212*d*, the other annular groove 212, the second communicating passage 237, and the oil passage 216*a* in the rocker shaft 216 to the oil pressure chamber 226*a* in the second rocker arm 226. The leak holes 232*d* are shifted so that the second communicating passage 237 is not communicated with the return through-hole 232*c*. The pressurized oil, branching at the second communicating passage 237, is delivered through the oil passage 216*a* in the rocker shaft 216, the coupling 248, the communicating pipe 249, and the coupling 50 to the oil passage 217*a* in the rocker shaft 217 on the exhaust valve side, and is then supplied to the oil pressure chamber 226*a* in the second rocker arm 226 on the exhaust valve side. Therefore, both on the intake valve side and on the exhaust valve side, the plunger pin 229 in the second rocker arm 226 is protruded into the first rocker arm 225 so that the first and second rocker arms 225 and 226 are engaged with each other. Therefore, the second rocker arm 226 is moved integrally with the first rocker arm 225, which is rocked by the cam 212*a* or 213*a*, as a result of which the intake valve 214 or the exhaust valve 215 is activated and operated.

When the oil pressure applied to the oil pressure chamber 226*a* is excessively high, the relief valve 238 is operated so that the oil flows through the third communicating passage 239 and the relief valve 238, thus preventing an undesirably great increase of oil pressure.

In the above-described embodiment, the cylindrical valve 232 is inserted into the one end portion of the cam shaft 212; however, the device may be modified so that the cylindrical valve is fitted over the cam shaft 212.

This embodiment has been described to a single-cylinder, four-valve engine; however, the technical concept of the invention is applicable to a multi-cylinder engine as well.

The first embodiment of the invention will be described with reference to FIGS. 7 through 10 in more detail.

The first embodiment is employed as an oil pressure changeover valve in the oil pressure circuit of a valve operating device having an operation suspending function in an internal combustion engine. The valve operating device has a cam shaft (or a rotary shaft) 11 which is supported by the cylinder head 10 and is rotated in association with the rotation of the engine. A rocker arm 12 is rockably mounted on a rocker shaft 13, the latter being supported by the cylinder head 10 in such a manner that the rocker arm follows the cam 11*a* provided on the cam shaft 11. The rocker arm 12 is composed of first and second rocker arms 14 and 15. The first and second rocker arm 14 and 15 can be detachably engaged with each other through a plunger pin 16.

An oil passage B (to the oil-pressure-operated part) is formed in the rocker shaft 13, which is communicated through a lead-in passage 17*a* to an oil pressure chamber 17 formed behind the plunger pin 16. When oil pressure is applied to the oil pressure chamber 17 in the rocker arm 12, the plunger pin 16 in the second rocker arm 15 in inserted into the first rocker arm 14 to engage the first and second rocker arms with each other. As a result, the second rocker arm, together with the first rocker arm 14 following the cam 11*a*, is swung about the rocker shaft 13, thereby causing the front end portion of the second rocker arm 15 to operate the intake or exhaust valve 18.

When the oil pressure is removed from the oil pressure chamber 17, the plunger pin 16 is restored by a return spring 19 so that the first and second rocker arms 14 and 15 are disengaged from each other. Therefore, even if the first rocker arm 14 swings following the cam 11*a*, the valve 18 abutted against the second rocker arm 15 is not operated. That is, the valve is idled.

An oil passage A is communicated with an oil pump (or an oil pressure supplying source). In accordance with the invention, an oil pressure changeover valve 20 is provided between the oil passage A extending from the oil pump and the oil passage B extending to the oil pressure chamber 27. The changeover valve 20 will be described in more detail.

A cylindrical hole 11*b* is formed in one end portion of the cam shaft 11 extending along the central axis of the one end portion. A rotary valve 23 has a cylindrical part 21 and an engaging end part 22. The cylindrical part 21 is rotatably inserted into the cylindrical hole 11*b*. The rotary valve 23 is fixed against the cylinder head 10 through a washer 24. A centrifugal governor 25 is mounted on the one end portion of the cam shaft 11 by a spline coupling. The centrifugal governor has weight arms 25*a* engaged with cuts 22*a* formed in the engaging end part of the rotary valve 23. As governor weights 25*b* coupled to the weight arms 25*a* are moved by centrifugal force, the rotary valve 23 is rotated.

A communicating passage $A_1$ (part of the oil passage A extending to the oil pump), a communicating passage $B_1$ (part of the oil passage B extending to the oil pressure chamber 17), and a relief passage 28 (communicated with a relief valve 27) are formed in a passage member 26 into which the one end portion of the cam shaft 11 is inserted.

As is illustrated best in FIGS. 4A and 4B, an annular groove 11*c* confronting the communicating passage $A_1$ and $B_1$ and the relief passage 28, and a communicating hole 11*d* communicating the annular groove 11*c* with the aforementioned cylindrical hole 11*b* are formed in the outer wall of the cam shaft 11. Furthermore, a return through-hole 21*a* is formed in the cylindrical part 21 of the rotary valve 23 extending parallel to the central axis. In order to communicate the return through-hole 21*a* with the annular groove 11*c*, radially extending leak holes 21*b* are formed in the cylindrical part 21 of the rotary valve 23.

As described above, when the rotation of the cam shaft 11 is in a low-speed range, as shown in FIGS. 7, 8A, 8B, 9 and 10, the oil pressure changeover valve 20 relieves the oil pressure chamber 17 in the rocker arm 12 from the oil pressure. When the speed of the cam shaft 11 reaches a predetermined high value, the rotary valve 23 is rotated relative to the cam shaft 11 by the centrifugal governor 25 (see FIG. 9). In this case, pressure relief is not provided by the oil pressure changeover valve 20. That is, the changeover valve 20 then communicates the oil passage A (including passage $A_1$) with the oil passage B (including passage $B_1$) to supply oil pressure to the oil pressure chamber 17. When the oil pressure applied to the oil pressure chamber 17 is excessively high, the relief valve 27 operates to cause the pressurized oil to flow through the relief passage 28, thereby preventing an increase in oil pressure to an undesirably high value.

Figure 7:
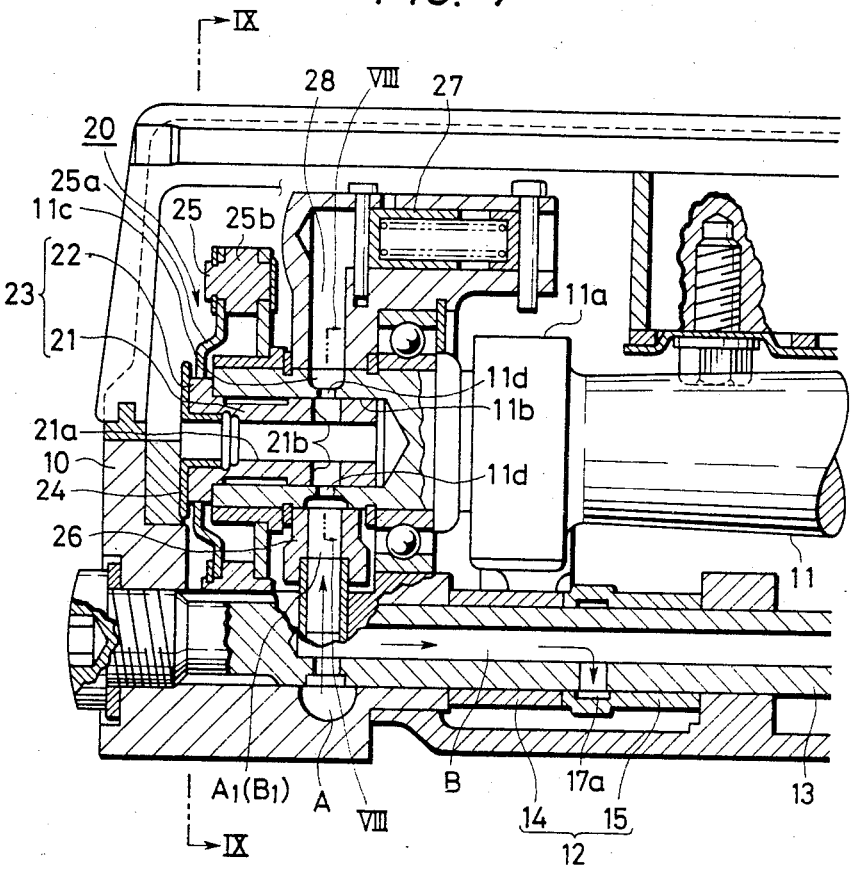
FIG. 7 is a sectional view showing an oil pressure changeover valve and related components provided at an end of a cam shaft.
Figure 9:
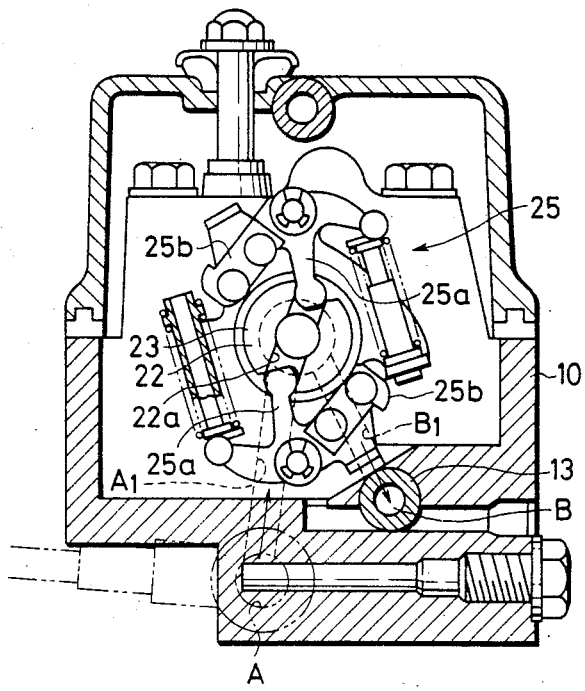
FIG. 9 is a sectional view taken along a line IX—IX in FIG. 7.
Figure 10:
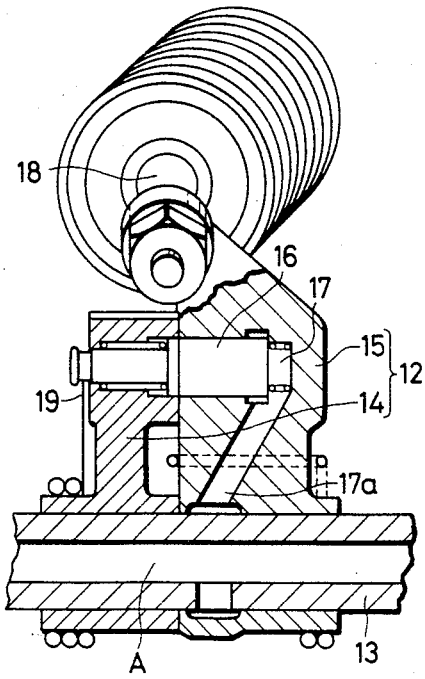
FIG. 10 is a horizontal sectional view of a part of a rocker arm.

In FIGS. 7 and 9, arrows indicate the flow of oil from the oil pressure supplying source to the oil pressure chamber 17.

In this first embodiment of the invention, one end of a weight arm 25*a* of the centrifugal governor 25 is engaged with the engaging end 22 of a rotary valve 23. An annular groove 11*c* communicating with a passage B (extending to an oil pressure supplying source) and a passage B (extending oil-pressure-operated part 17) is formed in the outer wall of a rotary shaft 11. Furthermore, a communicating hole 11*d* communicating the annular groove 11*c* with a cylindrical hole 11*b* is also formed in the outer wall of the rotary shaft 11. A radially extending leak hole 21*b* communicating the outside of a cylindrical part 21 with the atmosphere is formed in the rotary valve 23, communicating with the communicating hole 11*d* of the rotary shaft 11. When the centrifugal governor 25 rotates at a predetermined speed, the rotary valve 23 rotates relative to the rotary shaft 11, thus establishing a path between the passages A and B without communicating with the atmosphere, or establishing a path between the two passages A and B and the atmosphere via the inside 21*a* of the rotary valve (opened to the atmosphere).

In the first embodiment, when the rotary shaft 11 rotates at a low speed, the leak hole 21*b* of the rotary valve 23 is in alignment with the communicating hole 11*d* of the rotary shaft 11 and the annular groove 11*c* communicates with the inside 21*a* of the rotary valve 23 (opened to the atmosphere). Accordingly, the oil pressure from the pressure supplying source, applied to the inside 21*a* of the rotary valve 23, is not applied to the oil-pressure-operated part 17.

When the speed of the rotary shaft 11 reaches a predetermined high value, the rotary valve 23 is rotated relative to the rotary shaft 11 by the centrifugal governor 25 so that the leak hole 21*b* is shifted from the communicating hole 11*d*. As a result, the passages A and B, communicated with the annular groove 11*c*, are communicated without being opened to the atmosphere (under the condition that the pressure relief is not effected), and therefore the oil pressure from the pressure supplying source is applied to the oil-pressure-operated part 17.

The operation of the oil pressure changeover valve 120 of the second embodiment is very similar to that described hereinbefore.

Figure 11A:
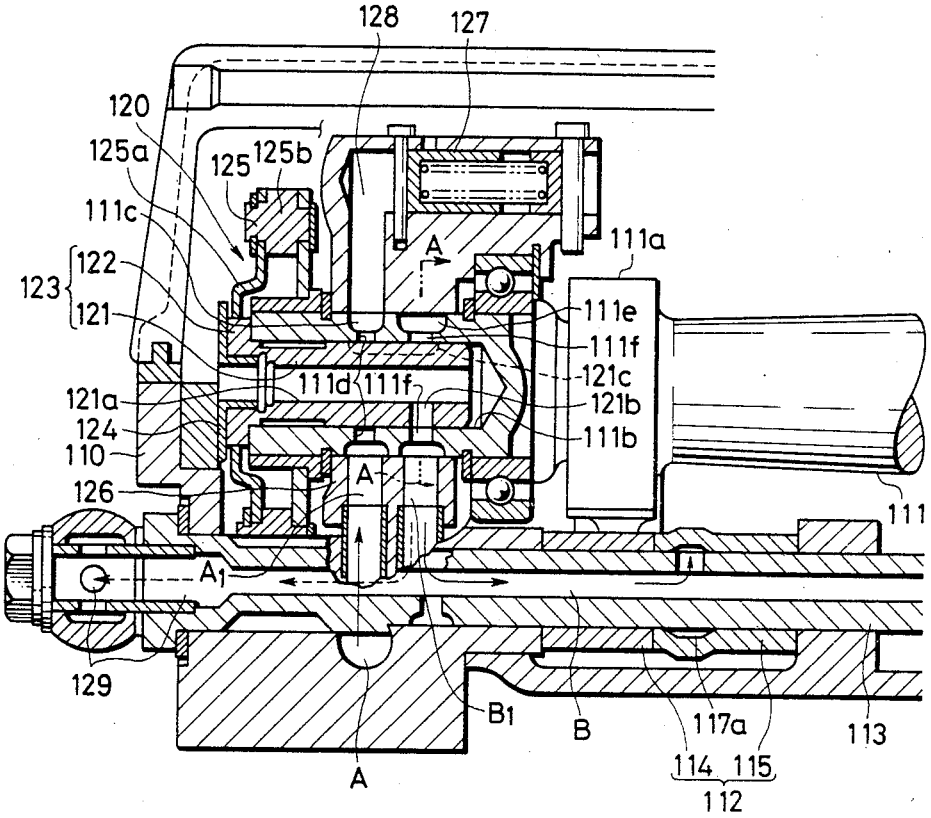
FIG. 11A is a sectional view showing an oil pressure changeover valve and related components provided at an end of a cam shaft.
Figure 11B:
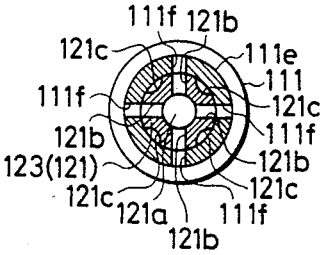
FIGS. 11B and 11C are sectional views taken along a line A—A in FIG. 11A, showing different states of the changeover valve.
Figure 11C:
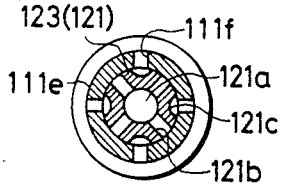

When the speed of the cam shaft 111 is in the range of low speed, as shown in FIGS. 11A and 11B, the oil pressure changeover valve 120 relieves the oil pressure. When the speed of the cam shaft 11 reaches a predetermined high value, the rotary valve 123 is rotated relative to the cam shaft 111 by the centrifugal governor 125, as shown in FIG. 11C. The changeover valve 120 allows the oil passage A (including $A_1$) to communicate with the oil passage B (including $B_1$) so that oil pressure is applied to the oil pressure chamber 117. In FIG. 11A, solid line arrows indicate the flow of oil from the oil pressure supplying source to the oil pressure chamber 117.

The second embodiment will be described with reference to a valve operating device having a plurality of rocker arms. In FIG. 11A, reference numeral 129 designates an oil passage adapted to supply oil pressure to the oil pressure chamber in one of the plurality of rocker arms. The flow of oil is indicated by the broken line arrow.

In accordance with the second embodiment of the invention, as shown in FIG. 11, two annular grooves, namely, a first annular groove 111*c* and a second annular groove 111*e*, are formed in the outer wall of a rotary shaft (only one annular groove being formed in the first embodiment described above). A communicating groove 121*c* communicating the first and second annular grooves 111*c* and 111*e* with each other is formed in the outer wall of a rotary valve 123 in such a manner that its position is different in phase from that of a leak hole 121*b* and it extends substantially parallel to the axis of the rotary valve. In the first embodiment, one annular groove is communicated with both the passage A extending to the oil pressure supplying source and the passage B extending to the oil-pressure-operated part, while, in the second embodiment, the passage A to the oil pressure supplying source is communicated with the first annular groove 111*c*, and the passage B to the oil-pressure-operated part 117 is communicated with the second annular groove 111*e*.

When the engine rotates at a high speed, the changeover valve, which is coupled to the centrifugal governor rotating with the cam shaft, is maintained open. Therefore, the oil from the oil pressure source is applied to the control mechanism in the rocker arm through the cam shaft passage and the oil passage in the rocker shaft, as a result of which the intake valve or exhaust valve is operated through the rocker arm by the cam. When the speed of rotation of the engine decreases so that the engine rotates in a predetermined range of speeds, then the centrifugal governor closes the changeover valve, as a result of which the oil from the oil pressure source is not applied to the control mechanism in the rocker arm. Thus, the valve idling condition is obtained, and the rotation of the cam is not transmitted to the intake or exhaust valve.

In the second embodiment, when the rotary shaft 111 rotates at a low speed, the leak holes 121*b* of the rotary valve 123 align with the communicating hole 111*f* on the side of the second annular groove 111*e* of the rotary shaft 111 and the second annular groove 111*e* communicates with the inside 121*a* of the rotary valve 123, which is opened to the atmosphere, while the communicating holes 111*d* and 111*f* of the first and second annular grooves 111*c* and 111*e* are shifted from the communicating groove 121*c* in the rotary valve 123, through which the first annular groove 111*c* is communicated with the second annular groove 111*e*. Accordingly, the second annular groove 111*e* is communicated with the inside 121*a* of the rotary valve 123, which is opened to the atmosphere, and the first annular groove 111*c* is closed. Therefore, the passage A to the pressure supplying source is closed by the rotary valve 123, and oil pressure is not applied to the oil-pressure-operated part 117, the oil flowing to the inside 121*a* of the rotary valve 123, which is opened to the atmosphere.

When the speed of the rotary shaft 111 reaches a predetermined high value, the rotary valve 123 is rotated relative to the rotary shaft 111 by the centrifugal governor 125 so that the leak holes 121*b* are shifted from the communicating hole 111*f* on the side of the cam shaft 111, thus being closed, and the communicating groove 121*c* aligns with the communicating hole 111*d* of the first annular groove 111*c* and the communicating hole 111*f* of the second annular groove 111*e* so that the first and second annular grooves 111*c* and 111*e* are communicated with each other. Accordingly, the passages A and B are communicated by the rotary valve 123 without being opened to the atmosphere (or under the condition that pressure relief is not effected), and therefore the oil pressure from the pressure supplying source is applied to the oil-pressure-operated part 117.

The conditions of the rotary valve at the high and low speeds may be opposite to those which have been described above.

The invention has been described with reference to a valve operating device having an operation suspending function. However, it should be noted that the invention is not limited thereto or thereby. That is, the technical concept of the invention is applicable to an oil pressure changeover valve which switches between a state in which oil pressure is applied to an oil-pressure-operated element from oil pressure supplying source and a state in which the oil-pressure-operated element is opened to the atmosphere.

As is apparent from the above description, the oil supplying passage extending to the control mechanism in the rocker arm is designed so as to pass through the changeover valve in the one end portion of the cam shaft, and the centrifugal governor for operating the changeover valve is provided at the one end of the cam shaft. Therefore, the mechanical arrangement for switching between the valve operating condition and the valve idling condition, which was heretofore difficult to realize, is realized according to the invention, providing the following effects:

Firstly, the number of components, and accordingly the manufacturing cost, can be reduced according to the invention. That is, the aforementioned method utilizing electrical control is similar to the invention in that the rotary speed is employed as a control signal. However, it is disadvantageous in that it is intricate in construction and high in manufacturing cost as a whole because a mechanical signal must be converted into an electrical signal by means of a pickup, and the electrical signal thus obtained subjected to calculation to operate the output solenoid, thereby to actuate the oil pressure changeover valve. On the other hand, the valve operating device of the invention is simple in construction, has a smaller number of components, and accordingly has a lower manufacturing cost.

Secondly, since the changeover valve is mounted close to the control mechanism, the latter has excellent response characteristics, and therefore switching between the valve operating condition and the valve idling condition can be accurately controlled.

Thirdly, the changeover valve and the centrifugal governor are arranged suitably so that the device requires a minimum space for installation.

As is apparent from the above-described first and second embodiments, in the inventive oil pressure changeover valve, operation is effected in the direction of rotation, which contributes to a decrease of the space in the axial direction. As the rotary shaft is utilized in such a manner that the rotary valve is provided in the end portion of the rotary shaft and is driven by the centrifugal governor mounted on the rotary shaft, the oil pressure changeover valve can be sufficiently compact. The passage is formed in the rotary valve extending along the axis thereof, and therefore the passages formed in the rotary valve are efficiently utilized, which further contributes to the compactness of the changeover valve.

In general, a valve operating device in which the rotary valve turns about the axial direction is smaller in inertial force than that in which it slides along the axial direction. Therefore, the former can be smaller in valve operating force than the latter. This means that the former has a faster response than the latter. Owing to the above-described effects, the mechanical oil pressure changeover valve can be installed at a place where it is otherwise rather difficult to install an oil pressure changeover valve, as in a valve operating device having a stopping function in an internal combustion engine.

We claim:

1. A valve operating device having a stopping function in an internal combustion engine, comprising: a cam shaft supported by a cylinder head and rotated in association with rotation of a crankshaft; and a rocker arm rockably mounted on a rocker shaft supported by said cylinder head to open and close an intake or exhaust valve following rotation of a cam mounted on said cam shaft, said rocker arm having an oil-pressure-operated control mechanism which stops the operation of said intake or exhaust valve according to operating conditions of said engine, in which:

a cam shaft passage is formed in an oil pressure supplying passage extending from an oil pressure source through an oil passage in said rocker shaft to said control mechanism in such a manner that said cam shaft passage passes through one end portion of said cam shaft, a changeover valve for opening and closing said cam shaft passage is provided at said one end portion of said cam shaft, and a centrifugal governor is provided at said one end portion of said cam shaft in such a manner that said centrifugal governor rotates with said cam shaft and turns changeover valve when the speed of said cam shaft is in a predetermined range, thereby to communicate said oil pressure source with said control mechanism.

2. A valve operating device having a stopping function in an internal combustion engine, comprising:

a cam shaft having a cylindrical hole;

a rotary valve comprising a cylindrical part and an engaging end part, said cylindrical part being rotatably inserted into said cylindrical hole; and a centrifugal governor mounted on one end portion of said cam shaft by spline coupling, in which:

said centrifugal governor has weight arms, each of which has one end engaged with an engaging end portion of a rotary valve, an annular groove communicated both with a passage to said oil pressure supplying source and with a passage to an oil-pressure-operated part and communicating holes for communicating said annular groove with a cylindrical hole are formed in an outer wall of a rotary shaft, radial leak holes communicating an outside of a cylindrical part of said rotary valve with an inside of said cylindrical part opened to the atmosphere are formed in said rotary valve in such a manner as to communicate with said communicating holes of said rotary shaft, and said rotary valve rotating relative to said rotary shaft when said centrifugal governor rotates at a predetermined speed, thereby to establish one of a communication condition in which said passages are not opened to the atmosphere and a communication condition in which said passages are communicated with said inside which is opened to the atmosphere.

3. A valve operating device having a stopping function in an internal combustion engine, comprising:

a cam shaft having a cylindrical hole;

a rotary valve comprising a cylindrical part and an engaging end part, said cylindrical part being rotatably inserted into said cylindrical hole; and a centrifugal governor mounted on one end portion of said cam shaft by spline coupling, wherein:

said centrifugal governor has weight arms each of which has one end engaged with an engaging end portion of a rotary valve, a first annular groove communicating with a first passage to an oil pressure supplying source and a second annular groove communicating with a record passage to an oil-pressure-operated part are formed in an outer wall of a rotary shaft, communicating holes communicating said first and second annular grooves with a cylindrical hole are provided, radial leak holes communicating an outside of a cylindrical part with an inside thereof which is opened to the atmosphere are formed in said rotary valve in such a manner as to communicate with said communicating holes of said rotary shaft, communicating grooves for communicating said first and second annular grooves with each other are provided in such a manner that said communicating grooves are different in phase from said leak holes formed in said outer wall of said rotary valve and extend substantially parallel to the axis of said rotary valve, and said rotary valve rotating relative to said rotary shaft when said centrifugal governor rotates at a predetermined speed, thereby to establish one of a communication condition in which said first and second passages are not opened to the atmosphere and a communication condition in which said first and second are not communicated with each other and said second passage is communicated with the inside of said rotary valve, which is opened to the atmosphere.

* * * * *